United States Patent [19]

Carmody et al.

[11] 4,415,036

[45] Nov. 15, 1983

[54] PRESSURE EQUALIZING FLAPPER TYPE SAFETY VALVE FOR SUBTERRANEAN WELLS

[75] Inventors: Michael A. Carmody, Broken Arrow; Michael L. Cognevich, Tulsa, both of Okla.

[73] Assignee: Baker Oil Tools, Inc., Orange, Calif.

[21] Appl. No.: 350,670

[22] Filed: Feb. 22, 1982

[51] Int. Cl.[3] ..... E21B 34/14

[52] U.S. Cl. ..... 166/324; 137/630.14

[58] Field of Search ..... 166/324, 325; 137/630.14, 630.15

[56] References Cited

U.S. PATENT DOCUMENTS

| | | | |
|---|---|---|---|
| 709,262 | 9/1902 | Gold | 137/630.15 |
| 2,879,799 | 3/1959 | Jansen et al. | 137/630.15 |
| 3,799,204 | 3/1974 | Watkins et al. | 166/324 |
| 4,308,894 | 1/1982 | Carpentier | 137/630.15 |

*Primary Examiner*—Stephen J. Novosad
*Assistant Examiner*—William P. Neuder
*Attorney, Agent, or Firm*—Novell & Associates

[57] ABSTRACT

The disclosure relates to a flapper type safety valve incorporating a pressure equalizing feature in the body of the flapper valve. A bypass aperture in the flapper valve communicates with a downwardly facing conical sealing surface. A conically shaped sealing plug is insertable in the bypass aperture and has a post portion projecting upwardly through such aperture. A diametral slot is provided in the top surface of the flapper valve body to mount a leaf spring which is secured to the upstanding post. An abutment element is also secured to the top end of the upstanding post and projects diametrically into the path of the actuating sleeve normally utilized to effect the opening of the flapper valve. The actuating sleeve thus contacts the abutment element prior to effecting any opening movement of the flapper valve and depresses the abutment element downwardly, against the bias of the leaf spring, to move the sealing plug downwardly and open the bypass aperture, thus equalizing pressure across the flapper valve body before any opening movement of the flapper valve body occurs.

15 Claims, 5 Drawing Figures

PRESSURE EQUALIZING FLAPPER TYPE SAFETY VALVE FOR SUBTERRANEAN WELLS

BACKGROUND OF THE INVENTION

1. Field of the Invention

The invention relates to a flapper type safety valve for subterranean wells and particularly to a pressure equalizing arrangement incorporated in the body of the flapper valve to facilitate the opening of the flapper valve.

2. Description of the Prior Art

Valve mechanisms have been employed in subterranean wells with the primary purpose of effecting a reliable, positive closure of the bore of a production tubing string in the event of any emergency. The actual valving elements of heretofore known valves have comprised ball valves, flapper valves, poppet valves and axially shiftable block elements. Regardless of the type of valving element employed, there has been a problem of effecting the reliable opening of such a valve whenever a significant pressure differential exists between the lower surface of the valve element and the upper surface.

A common form of actuator for a flapper valve is a sleeve which is driven downwardly by a piston shoulder through the imposition of a control fluid pressure supplied from the top of the well head. If a significant pressure differential exists across the flapper valve in its closed position, the amount of force required to be imposed by the actuating sleeve may well cause damage to the sleeve, the flapper valve, or the pivot mounting of the flapper valve. There is, therefore, a need for a pressure equalizing mechanism which accomplishes the equalization of such pressure differential as an automatic consequence of an initial movement of the actuator to open the valve.

Preferably, any type of pressure equalizing mechanism should be simple, reliable, economical to manufacture, and should not result in a significant increase in the diametral dimensions of the tubular conduit in which the flapper valve is mounted. Pressure equalizing arrangements for flapper valves have heretofore been proposed. See for example U.S. Pat. No. 3,799,204 and the co-pending application Ser. No. 259,767 filed May 1, 1981 and assigned to the Assignee of the instant invention. Such prior art equalizing arrangements either involve the incorporation of bypass valves mounted in the tubular conduit or, in the case of the aforementioned co-pending application, involve a pressure equalizing valving arrangement incorporated in the body of the flapper but resulting in a substantial increase in the thickness of the flapper, thus increasing the diametrical dimensions of the safety valve housing in order to accommodate the thicker flapper in its vertical, open position.

SUMMARY OF THE INVENTION

This invention provides an automatic pressure equalizing feature for a flapper type safety valve wherein the pressure equallization mechanism is entirely contained within the body of the flapper valve and, even more significantly, does not result in any substantial increase in the thickness of the flapper valve, hence eliminating any increase in diameter of the tubular conduit within which the flapper valve is mounted.

A flapper valve embodying this invention is conventionally pivotally mounted on a horizontal pivot pin provided on one side of a tubular conduit. The same tubular conduit defines a downwardly facing, annular sealing surface with which the flapper valve cooperates in sealing relation in its closed, horizontal position. The opening of the flapper valve is accomplished by the downward movement of a fluid pressure responsive actuating sleeve which engages the flapper valve and pushes it downwardly as the sleeve moves downwardly through the bore of the annular sealing surface.

The flapper valve is provided with a central bypass aperture which is conically flared at its bottom end to define a downwardly facing, conical sealing surface. A sealing plug is insertable in the bypass aperture and is provided with a corresponding conical surface to sealingly engage the downwardly facing conical surface of the bypass aperture. An upstanding post on the sealing plug projects upwardly through the bypass aperture and is secured to a leaf spring which is mounted in a diametrically disposed, generally rectangular slot formed in the upper surface of the flapper valve. The leaf spring normally maintains the conical sealing plug in sealing engagement with the downwardly facing, conical sealing surface of the bypass aperture.

To effect the automatic opening of the bypass aperture, a diametrically extending abutment element is secured to the upstanding post and projects into the path of the downwardly moving, pressure driven, actuating sleeve. The actuating sleeve first contacts the diametrically disposed abutment element, resulting in the depressing of the post portion of the sealing plug and the opening of the bypass aperture, thereby substantially equalizing the fluid pressure above and below the flapper valve before any substantial downward force is directly applied to the flapper body by the downwardly moving actuating sleeve.

Further objects and advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1:
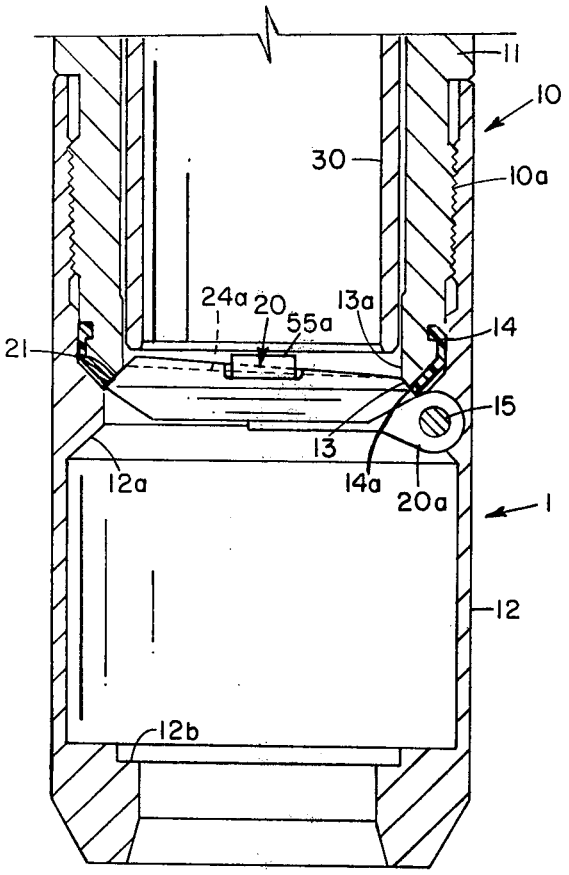
FIG. 1 is a vertical sectional view of a safety valve incorporating an improved pressure equalizing flapper valve embodying this invention, with the valve elements being shown in their closed position.

Referring to FIG. 1, a pressure equalizing flapper valve embodying this invention is shown as a safety valve 1 commonly employed in subterranean wells. The safety valve 1 comprises a primary tubular conduit or assemblage 10 including an upper body portion 11 and a lower sleeve-like body portion 12 interconnected by threads 10*a*. On the bottom end of upper body portion 11, there is defined a downwardly facing annular sealing surface or seat 13. In the particular example illustrated in the drawings, this sealing surface is augmented by an annular elastomeric element 14 which has an end face 14*a* in general alignment with the sealing surface 13. The primary conduit 10 is further provided with means for mounting a horizontal pivot pin 15. In the particular construction illustrated in the drawing, pivot pin 15 is supported by an aperture in an internally projecting annular shoulder 12*a* provided in the lower body portion 12.

A flapper valve 20 embodying this invention is pivotally mounted to the conduit 10 by the horizontal pivot pin 15 transversing mounting lugs 20*a* and, in FIG. 1, is shown in its generally horizontal, closed position wherein an annular upwardly facing surface 21 of the flapper valve 20 is in sealing engagement with the downwardly facing sealing surface 13 and the annular elastomeric sealing surface 14*a*. A conventional torsion spring (not shown) is provided in surrounding relationship to the pivot pin 15 to urge the flapper valve 20 to its closed position as shown in FIG. 1.

Figure 2:
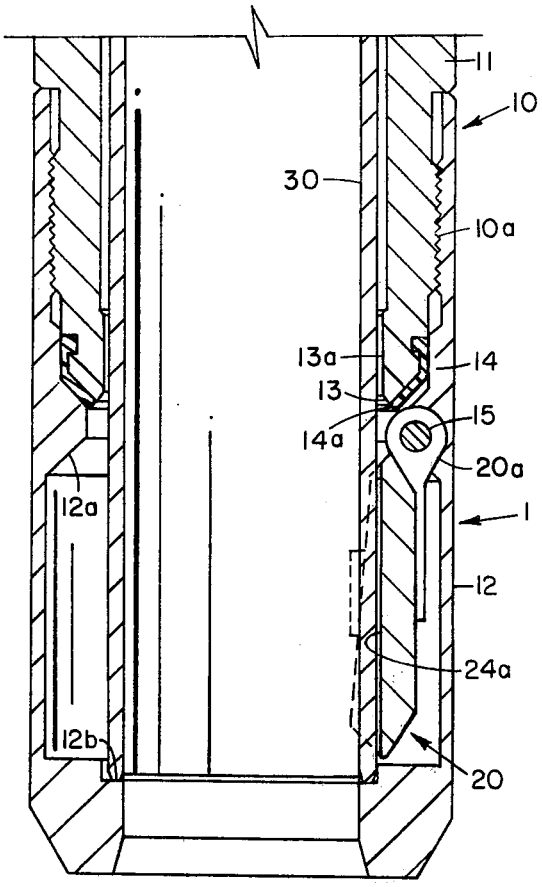
FIG. 2 is a view similar to FIG. 1 but illustrating the flapper valve in its open position.

As is well known to those skilled in the art, and is more fully described in the aforementioned co-pending application, the flapper valve 20 is moved to an open position by the downward movement of a sleeve 30 which is driven downwardly by a piston shoulder (not shown) to which control fluid pressure is applied. Full details of the construction and operation of the actuating sleeve 30 will be found in the aforementioned co-pending application. The application of control pressure effects the downward shifting of the actuating sleeve 30 to move through the bore 13*a* defined by the annular sealing surface 13 and shift the flapper valve 20 to a vertical position as shown in FIG. 2. The downward movement of the actuating sleeve 30 is limited by an inwardly projecting shoulder 12*b* formed on the lower conduit body portion 12.

Figure 5:
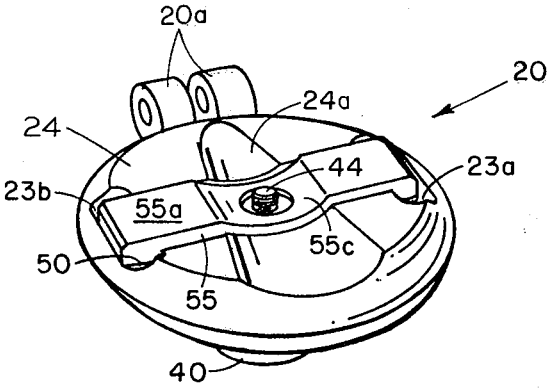
FIG. 5 is a perspective view of the flapper valve embodying this invention.
Figure 4:
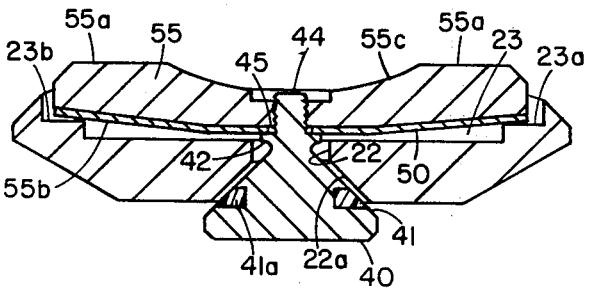
FIG. 4 is a view similar to FIG. 3 but showing the pressure equalizing elements of the flapper valve in their open position.
Figure 3:
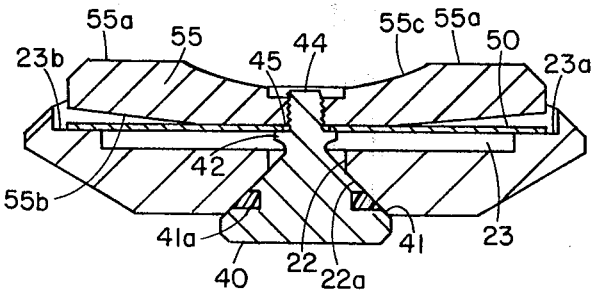
FIG. 3 is an enlarged scale, vertical sectional view of the flapper valve employed in FIG. 1, showing the pressure equalizing elements thereof with the pressure equalizing valve being disposed in its closed position.

Referring now to the enlarged scale views of FIGS. 3, 4 and 5, the detailed construction of the pressure equalizing feature incorporated in the flapper valve 20 can be more conveniently described. The flapper valve 20 is provided with a central bypass aperture 22 having an outwardly flared, downwardly facing conical sealing surface 22*a*. The upper surface of the flapper valve 20 is provided with a diametrically extending, generally rectangular recess 23 having upstanding ledges 23*a* and 23*b* respectively at its opposite ends.

A sealing plug 40 is provided having a conical surface 41 corresponding to the downwardly facing sealing surface 22*a* of bypass aperture 22. If desired, an elastomeric sealing element 41*a* may be incorporated in the conical sealing surface 41. Sealing plug 40 is further provided with an upwardly projecting post portion 42 which terminates in a threaded top portion 44 and defines an upwardly facing support shoulder 45 at the bottom of the threaded portion 44. Post portion 42 projects upwardly through the bypass aperture 22.

A leaf spring 50 is inserted in the diametral recess 23 and has its opposite ends respectively resting on the ledges 23*a* and 23*b*. A central portion of leaf spring 50 is apertured to permit its mounting on the threaded post portion 44. Leaf spring 50 is secured against the support shoulder 45 by an abutment member 55 which is provided with a central threaded bore for securement to the threaded post portion 44. The abutment 55 is of generally rectangular, bar-like configuration and overlies the entire length of the leaf spring 50. Leaf spring 50 thus biases sealing plug 40 upwardly to its closed position.

The upper surfaces 55*a* at each end of abutment element 55 are normally disposed slightly above the plane of the upper surface 24 of the flapper valve 20. Hence, upon downward movement of the actuating sleeve 30, the first elements of the flapper valve assemblage contacted by the actuating sleeve 30 are the end surfaces 55*a* of the abutment element 55. The downward force applied to the abutment element 55 by the actuating sleeve 30 produces a downward deflection of the leaf spring 50 and hence a downward displacement of the sealing plug 40. To facilitate the downward movement of the abutment member 55, the bottom surface 55*b* of abutment member 55 is curved or inclined upwardly away from the generally horizontal surface of the leaf spring 50 in a convex shape. Accordingly, the leaf spring 50 is free to have its central portion deflect downwardly to accommodate the downward movement of the abutment member 55 and sealing plug 40.

Such downward movement of the sealing plug 40 opens up the bypass aperture 22 through the flapper valve 20 and equalizes any pressure differential existing across the valve. It should be noted that the employment of the conical sealing surfaces 22*a* and 41 result in a significantly large flow area being established through the bypass passage 22 through a very slight axial downward displacement of the sealing plug 40. This reduces the tendency to create high velocity jet streams of fluid in the initial opening of the bypass passage 22 with attendant erosion damage to the sealing surface.

As best shown in FIG. 5, the flapper valve 20 has its top surface 24 provided with a cylindrical segment recess 24*a*. Recess 24*a* has the same external diameter as the actuating sleeve 30 so that the flapper valve 20, in its open vertical position, will conform to the walls of the actuating sleeve 30 and thus minimize the diametral dimension required for the tubular conduit 10. The actuating element 55 is also provided with a cylindrical segment recess 55*c* in its upper surface so as to conform in all respects to the cylindrical segment recess 24*a* provided in the body of the flapper valve 20 and thus abut the exterior of the actuating sleeve 30 in the open position.

It is therefore apparent that the described construction provides a pressure equalizing feature incorporated in the body of a flapper valve without significantly increasing the thickness of the flapper valve, hence permitting the normal diametral dimensions of the housing containing the safety valve to be maintained at a minimum.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A flapper type safety valve for a subterranean well comprising, in combination, a tubular conduit, means on said tubular conduit defining a downwardly facing, annular valve seat, a flapper valve having an annular surface cooperable with said valve seat in sealing relation, pivot means on one side of said tubular conduit for mounting said flapper valve to said conduit to permit downward pivotal movement of said flapper valve away from said valve seat to a vertical position, resilient means urging said flapper valve to its closed sealing position, a valve actuating sleeve disposed in said tubular conduit, means for moving said actuating sleeve downwardly to engage and open said flapper valve, said flapper valve having a bypass aperture therethrough defining a downwardly facing annular sealing surface, a sealing plug insertable in said bypass aperture from the bottom, whereby well fluid pressure below said flapper valve urges said plug into sealing engagement with said downwardly facing sealing surface, means including a leaf spring diametrically traversing said flapper valve for biasing said sealing plug upwardly into sealing engagement with said downwardly facing annular sealing surface to maintain said bypass aperture closed, upstanding means on said sealing plug projecting upwardly through said bypass aperture, and abutment means secured to said upstanding means and projecting into the path of downward movement of said actuating sleeve, whereby initial downward movement of said actuating sleeve shifts said sealing plug downwardly to open said bypass aperture.

2. The flapper type safety valve of claim 1 wherein said downwardly facing annular sealing surface comprises a conical segment surface and said sealing plug defines a cooperating conical surface effecting a wedged engagement with said annular sealing surface, whereby a small axially downward displacement of said sealing plug opens a large area fluid passage through said bypass aperture.

3. The flapper type safety valve of claim 1 wherein said upstanding means on said sealing plug comprises a post having a support shoulder, said leaf spring being apertured to mount on said post and engage said support shoulder.

4. The flapper type safety valve of claim 3 wherein the top end of said post threadably engages said abutment means and claims said leaf spring to said shoulder.

5. A flapper type safety valve for a subterranean well comprising, in combination, a tubular conduit, means on said tubular conduit defining a downwardly facing, annular valve seat, a flapper valve having an annular surface cooperable with said valve seat in sealing relation, pivot means on one side of said tubular conduit for mounting said flapper valve to said conduit to permit downward pivotal movement of said flapper valve away from said valve seat to a vertical position, resilient means urging said flapper valve to its closed sealing position, a valve actuating sleeve disposed in said tubular conduit, means for moving said actuating sleeve downwardly to engage and open said flapper valve, said flapper valve having a bypass aperture therethrough defining a downwardly facing annular sealing surface, a sealing plug insertable in said aperture from the bottom whereby well fluid pressure below said flapper valve urges said plug into sealing engagement with said downwardly facing sealing surface, an upwardly open slot diametrically traversing the upper surface of said flapper valve and overlying said bypass aperture, a pair of horizontal ledges respectively formed in opposed ends of said slot, a leaf spring insertable in said slot with opposed ends thereof respectively supported on said ledges, upstanding means on said sealing plug projecting upwardly through said bypass aperture and engagable with said leaf spring, and abutment means secured to said upstanding means and projecting into the path of downward movement of said actuating sleeve, whereby initial downward movement of said actuating sleeve shifts said sealing plug downwardly to open said bypass aperture.

6. The flapper type safety valve of claim 5 wherein said downwardly facing annular sealing surface comprises a conical segment surface and said sealing plug defines a cooperating conical surface effecting a wedged engagement with said annular sealing surface, whereby a small axially downward displacement of said sealing plug opens a large area fluid passage through said bypass aperture.

7. The flapper type safety valve of claim 5 wherein said upstanding means on said sealing plug comprises a post having a support shoulder, said leaf spring being apertured to mount on said post and engage said support shoulder.

8. The flapper type safety valve of claim 7 wherein the top end of said post threadably engages said abutment means and clamps said leaf spring to said shoulder.

9. A flapper type safety valve for a subterranean well comprising, in combination, a tubular conduit, means on said tubular conduit defining a downwardly facing, annular valve seat, a flapper valve having an annular surface cooperable with said valve seat in sealing relation, pivot means on one side of said tubular conduit for mounting said flapper valve to said conduit to permit downward pivotal movement of said flapper valve away from said valve seat to a vertical position, resilient means urging said flapper valve to its closed sealing position, a valve actuating sleeve disposed in said tubular conduit, means for moving said actuating sleeve downwardly to engage and open said flapper valve, said flapper valve having a bypass aperture defining a downwardly facing conical segment surface; a sealing plug insertable in said bypass aperture from the bottom and defining a cooperating conical surface effecting a wedged engagement with said annular sealing surface with said annular sealing surface, whereby well fluid pressure below said flapper valve urges said plug into sealing engagement with said downwardly facing sealing surface, upstanding means on said sealing plug projecting upwardly through said bypass aperture, and abutment means secured to said upstanding means and projecting into the path of downward movement of said actuating sleeve, whereby initial downward movement of said actuating sleeve shifts said sealing plug downwardly to open said bypass aperture.

10. In a downhole flapper type safety valve having a primary tubular conduit having a downwardly facing, annular valve seat surrounding the conduit bore, horizontal pivot pin mounting means adjacent the valve seat and a fluid pressure responsive actuating sleeve movable downwardly through the annular valve seat, the improvement comprising a flapper valve having an annular surface cooperable with said valve seat, means on said flapper valve for mounting same on a horizontal pivot pin to permit downward pivotal movement of said flapper valve away from said valve seat to a vertical position, resilient means urging said flapper valve to its closed sealing position, said flapper valve having a bypass aperture therethrough defining a downwardly facing annular sealing surface, a sealing plug insertable in said aperture from the bottom whereby well fluid pressure below said flapper valve urges said plug into sealing engagement with said downwardly facing sealing surface, means including a leaf spring diametrically traversing said flapper valve for biasing said plug upwardly into sealing engagement with said downwardly facing annular sealing surface to maintain said bypass aperture closed, upstanding means on said sealing plug projecting upwardly through said bypass aperture, and abutment means secured to said upstanding means and projecting into the path of downward movement of said actuating sleeve, whereby initial downward movement of said actuating sleeve shifts said sealing plug downwardly to open said bypass aperture.

11. The improvement of claim 10 wherein said downwardly facing annular sealing surface comprises a conical segment surface and said sealing plug defines a cooperating conical surface effecting a wedged engagement with said annular sealing surface, whereby a small axially downward displacement of said sealing plug opens a large area fluid pressure through said bypass aperture.

12. The improvement of claim 10 wherein said upstanding means on said sealing plug comprises a post having a support shoulder, said leaf spring being apertured to mount on said post and engage said support shoulder.

13. The improvement of claim 12 wherein the top end of said post threadably engages said abutment means and clamps said leaf spring to said shoulder.

14. The improvement of claim 10 plus an upwardly open, generally rectangular slot diametrically traversing the upper surface of said flapper valve and overlying said bypass aperture, a pair of horizontal ledges respectively formed in opposed ends of said slot, a leaf spring insertable in said slot with opposed ends thereof respectively supported on said ledges, upstanding means on said sealing plug projecting upwardly through said bypass aperture and engagable with said leaf spring, and abutment means secured to said upstanding means and projecting into the path of downward movement of said actuating sleeve, whereby initial downward movement of said actuating sleeve shifts said sealing plug downwardly to open said bypass aperture.

15. The apparatus defined in claim 14 wherein said abutment means comprises a diametral bar overlying said leaf spring, said bar having a convex bottom surface to provide clearance for downward deflection of the central portions of said leaf spring.

* * * * *